United States Patent [19]

Garneau

[11] Patent Number: 4,669,664

[45] **Date of Patent: * Jun. 2, 1987**

[54] HAND MANIPULATABLE SPRAYER

[75] Inventor: Richard P. Garneau, Davie, Fla.

[73] Assignee: Waynesboro Textiles, Inc., Forest City, N.C.

[ * ] Notice: The portion of the term of this patent subsequent to Jul. 9, 2002 has been disclaimed.

[21] Appl. No.: 674,936

[22] Filed: Nov. 26, 1984

Related U.S. Application Data

[63] Continuation-in-part of Ser. No. 597,838, Apr. 9, 1984, Pat. No. 4,527,594, which is a continuation-in-part of Ser. No. 503,907, Jun. 13, 1983, Pat. No. 4,527,741.

[51] Int. Cl.[4] ..... B05B 9/043

[52] U.S. Cl. ..... 239/333; 222/383; 137/853

[58] Field of Search ..... 239/329, 330, 333, 334; 222/207, 209, 383-385, 380; 137/843, 853, 854

[56] References Cited

U.S. PATENT DOCUMENTS

| | | | |
|---|---|---|---|
| 3,061,202 | 10/1962 | Tyler | 222/383 X |
| 3,185,355 | 5/1965 | Lipman | 222/384 X |
| 3,250,219 | 5/1966 | McCarty | 137/854 X |
| 3,399,836 | 9/1968 | Pechstein | 239/333 |
| 3,476,142 | 11/1969 | Schultz | 137/854 X |
| 3,507,586 | 4/1970 | Gronemeyer et al. . | |
| 3,680,790 | 8/1972 | Boris | 239/353 |
| 3,715,060 | 2/1973 | Benson | 222/383 X |
| 4,072,252 | 2/1978 | Steyns et al. | 222/341 |
| 4,079,865 | 3/1978 | Kutik | 222/321 X |
| 4,222,501 | 9/1980 | Hammett et al. | 222/207 |
| 4,234,128 | 11/1980 | Quinn | 222/554 X |
| 4,257,539 | 3/1981 | Cary et al. | 222/383 X |
| 4,307,731 | 12/1981 | Kaufman | 137/854 X |
| 4,325,501 | 4/1982 | Shay | 222/383 X |
| 4,350,298 | 9/1982 | Tada | 239/333 |
| 4,365,751 | 12/1982 | Saito et al. | 239/333 |
| 4,429,856 | 2/1984 | Jackson | 137/843 X |
| 4,503,998 | 3/1985 | Martin | 239/333 X |
| 4,527,594 | 7/1985 | Garneau | 137/854 |
| 4,527,741 | 7/1985 | Garneau | 239/333 |

FOREIGN PATENT DOCUMENTS

| | | | |
|---|---|---|---|
| 57357 | 1/1975 | Australia | 239/333 |

*Primary Examiner*—Andres Kashnikow
*Assistant Examiner*—Kevin Patrick Weldin
*Attorney, Agent, or Firm*—Thomas R. Vigil

[57] ABSTRACT

The hand manipulatable sprayer (10) is connectable to a container (26) and includes a body (12) having a pump assembly (120) and a check valve assembly (90). The check valve assembly (90) includes at least one conically-shaped skirt valve member (100,112). Also the body (12) can have a cavity (68) adapted to receive similarly shaped inserts (67) for different valve assemblies (90), a cylindrical cavity (68) for receiving various size pistons (34) together with a mating cylindrical insert (43) and a nose formation (15,142,143) adapted to receive nozzle assemblies (14) similarly shaped but of different types and a passageway (96,97) extending from the cavity (68) to and opening on the nose formation (15).

40 Claims, 8 Drawing Figures

HAND MANIPULATABLE SPRAYER

CROSS REFERENCE TO RELEATED APPLCATIONS

This application is a continuation-in-part of U.S. patent application Ser. No. 597,838 for: CHECK VALVE filed Apr. 9, 1984 and now issued to U.S. Pat. No. 4,527,594 on July 9, 1985 which is a continuationin-part of U.S. patent application Ser. No. 503,907 filed June 13, 1983, for: TRIGGER PUMP SPRAYER and now issued to U.S. Pat. No. 4,527,741 on July 9, 1985.

BACKGROUND OF THE INVENTION

1. Field of the Invention

The present invention relates to a hand or finger manipulatable, e.g. trigger, sprayer with a check valve therein and more specifically to a sprayer of the type which is mounted to the top of a container of liquid and which has a central element, such as a trigger, which can be depressed or squeezed to cause pumping and dispensing of liquid from a nozzle of the sprayer and wherein the check valve includes a conical skirt shaped or umbrella shaped valve member.

2. Description of the Prior Art

Trigger sprayers with adjustable multi-purpose nozzle assemblies are disclosed in the Quinn et al U.S. Pat. No. 4,234,128 and the Micallef U.S. Pat. Nos. 3,843,030 and 3,967,765.

Other adjustable or removable nozzles are disclosed in the Shay U.S. Pat. No. 4,313,568, the Reeve U.S. Pat. No. 4,204,614 and the Pauls et al U.S. Pat. No. 4,241,853.

Liquid dispensers utilizing upper and lower inline ball type check valves are disclosed in the Cooprider U.S. Pat. No. 3,062,416, the Hammett et al U.S. Pat. No. 4,222,501, and the Ford et al U.S. Pat. No. 4,340,158.

Other dispensers using two ball type check valves are disclosed in the Pasteur French Patent No. 1,333,491 and in the Davis U.S. Pat. No. 2,699,271.

A seating and retaining structure on the back side of a trigger handle for the forward end of a plunger or piston in a triggers prayer are disclosed in the Tada U.S. Pat. No. 4,153,203 and in the Cary et al U.S. Pat. No. 4,260,079.

Other types of plunger-trigger handle couplings are disclosed in the Tyler U.S. Pat. No. 3,061,202, the Malone U.S. Pat. No. 3,650,473, the Vanier U.S. Pat. No. 3,685,739 and the Steyns et al U.S. Pat. No. 4,072,252.

Guide pins, rods or posts for a biasing spring in a trigger sprayer are disclosed in the Tyler U.S. Pat. No. 3,061,202, the Tada U.S. Pat. No. 3,701,478, the Tada U.S. Pat. No. 3,770,206, the Maline U.S. Pat. No. 3,650,473, the Vanier U.S. Pat. No. 3,685,739 and the Steyns et al U.S. Pat. No. 4,072,252.

Venting of a bottle on a pumping stroke in a trigger sprayer without affecting the seal between a sprayer cap and the bottle is disclosed in the Steyns et at U.S. Pat. No. 4,072,252.

Eccentric or off-center mounting of a dip tube in a trigger sprayer is disclosed in the Grogan U.S. Pat. No. 4,138,038, the Blake U.S. Pat. No. 4,155,487 and the Reeve U.S. Pat. No. 4,204,614.

Furthermore various flap type valves have been proposed for use in trigger sprayers. Examples of such flap type valves are disclosed in the Miller U.S. Pat. No. 3,130,871, the Humphrey U.S. Pat. No. 3,486,663, the Davidson et al U.S. Pat. No. 3,726,442, the Micallef U.S. Pat. No. 3,749,290, the Schmidt et al U.S. Pat. No. 3,973,700, the Grogan U.S. Pat. No. 3,986,644, the Cooprider et al U.S. Pat. No. 3,987,938, the Cooprider et al U.S. Pat. No. 3,995,774, the Alef U.S. Pat. No. 4,201,317 and the Blake et al U.S. Pat. No. 4,225,061.

Also, an O-ring type valve is disclosed in U.S. Pat. No. 3,768,734.

Although non-analogus art, it is noted that it has been proposed to use a conical skirt shaped valve in a fluid check valve for general use. See, for example, Kersh U.S. Pat. No. 2,912,999, the Roberts U.S. Pat. No. 2,913,000 and the Moore Jr. et al U.S. Pat. No. 2,949,929.

As will be described in greater detail hereinafter the hand manipulatable sprayer of the present invention differs from the previously proposed trigger sprayers having flap type valves and O-ring type valves therein by providing a simple, inexpensive plastic valve element which has a frusto-conical skirt or umbrella-like configuration that frictionally and sealingly engages with a cylindrical wall of a bore in a body of a sprayer and which is deflectable radially inwardly by fluid pressure so as to allow the pressurized fluid to pass around the skirt or umbrella-like configuration and downstream of the check valve during pumping of the sprayer.

SUMMARY OF THE INVENTION

According to the invention there is provided, a hand manipulatable trigger sprayer comprising:

a body having an outer surface, passage means therein including a linear passageway portion, said passage means extending between an inlet adapted to be coupled to a source of liquid to be dispensed and an outlet adapted to be connected to a nozzle through which the liquid is dispensed, said linear passageway portion having a cylindrical wall, said body further having a pump chamber therein defined by an inner end wall and an open outer end opening onto said outer surface of said body and an opening extending into said inner wall and said body, said opening communicating between said pump chamber and said passage means, first upstream check valve means in said passage means between said inlet and said opening for permitting forward flow of liquid from the source into said passage means but not reverse flow to the source, second, downstream check valve means in said linear passageway portion downstream from said opening for permitting forward flow of liquid to said outlet, but not reverse flow to said pump chamber, said second upstream check valve means comprising a flexible, frusto-conical shaped skirt member which flates outwardly in a downstream direction to an outer circular end edge, which is prevented from moving axially downstream in said linear passageway portion, and which has an outer marginal area adjacent said end edge that normally is in engagement with said cylindrical wall of said linear passageway portion, said skirt member being deformable radially inwardly under liquid pressure to allow liquid to flow downstream past said skirt member, pumping means comprising a piston which is situated in said pump chamber and which has an outer end and an inner end and means for biasing said inner end of said piston away from said inner end wall of said pump chamber, and actuating means comprising a trigger and means for mounting said trigger to said body in a manner allowing movement of said trigger relative to said body, said trigger being positioned to engage said outer end of said piston for moving said piston, once said trigger is squeezed, into said pump chamber against said biasing means to force liquid from said pump chamber through said opening, into said passage means and past said skirt member, and, when said trigger is released, said biasing means forces said piston away from said inner end wall creating a suction which draws liquid from the source through said first upstream check valve means into said passage means through said opening and into said pump chamber.

DESCRIPTION OF THE PREFERRED EMBODIMENT

Figure 1:
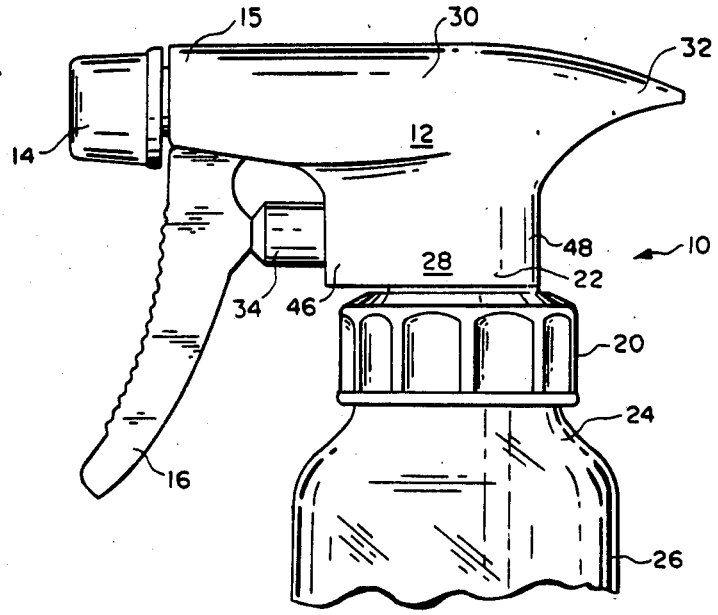
FIG. 1 is a side elevational view of a trigger sprayer.

Referring now to FIG. 1 in greater detail, there is illustrated therein, a trigger sprayer generally identified by the reference numeral 10. The sprayer 10 includes a body 12, a nozzle assembly 14 coupled to an outlet end 15 of body 12, a trigger handle 16 pivotally mounted internally of body 12, and a cap 20 coupled to an inlet end 22 of the body 12 and adapted to be connected to a neck 24 of a container or bottle 26.

As shown, the body 12 has a generally T-shape with a wide downwardly lower body portion 28 extending to the inlet end 22 connected to cap 20, and a horizontally extending upper body portion 30 having the outlet end 15 at one end thereof and a fairing or shroud 32 at the other end thereof. The shape of body 12 can, of course, have any desired shape and is not limited to a T-shape.

A piston or plunger 34 extends from the lower body portion 28 as shown in FIG. 1 and has a rounded yoke 36 (FIG. 2) in engagement with a seat formation 38 formed on back side 40 of the trigger handle 16. An inner portion 42 (FIG. 2) of the piston 34 is received in a sleeve 43 received in a cylindrical cavity 44 (FIG. 2) extending from a front side 46 of the lower body portion 28 generally horizontally into the lower body portion 28. A back side 48 of lower body portion 28 is rounded and forms with the trigger handle 16, a gripping formation by which a user of the trigger sprayer 10 can grip the sprayer 10 with one hand and squeeze to cause the trigger handle 16 to push the piston 34 into the sleeve 43 and cavity 44 against the force of a biasing spring 50 (FIG. 2) in the sleeve 43 and cavity 44. Although the piston 34 is actually received in the sleeve 43 that is press-fitted into the cavity 44, reference will be made to the piston 34 being received in the cavity 44 only.

As will be described in greater detail hereinafter, squeezing of the trigger handle 16 will cause liquid to be expressed in a spray from the nozzle assembly 14 and on release of the handle 16, the spring 50, acting against the piston 34 and urging it outwardly, causes liquid to be drawn into the cavity 44 in the lower body portion 28.

Figure 2:
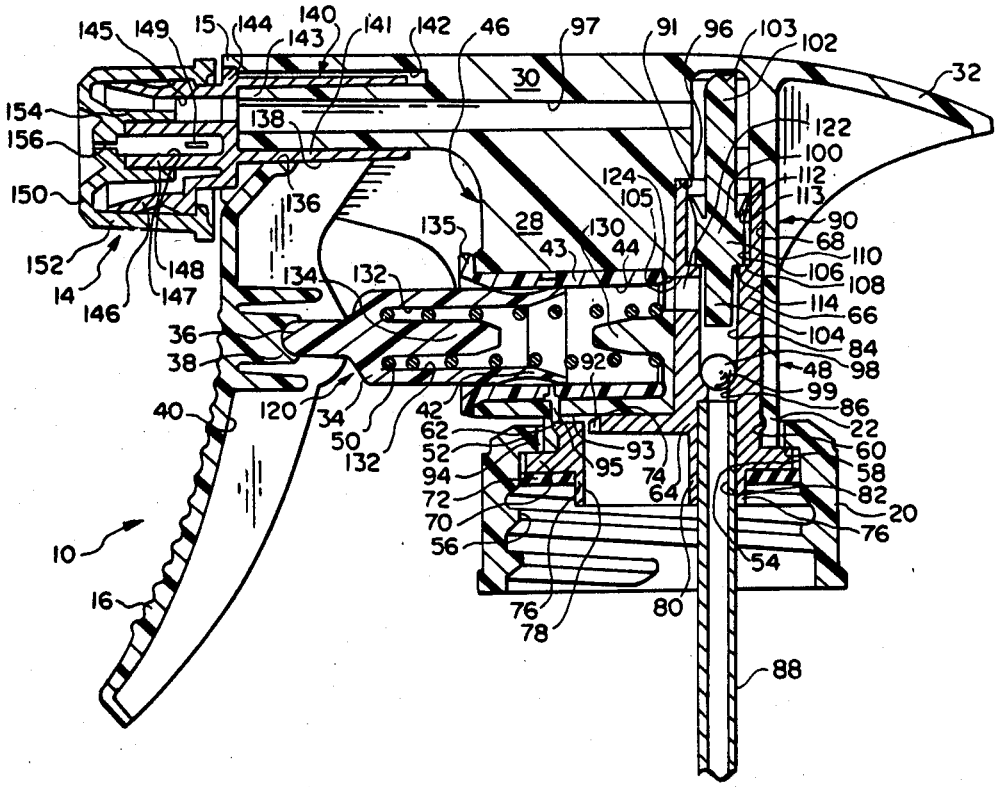
FIG. 2 is a vertical sectional view of the trigger sprayer shown in FIG. 1 and shows a valving system employing a ball valve and a conical skirt/umbrella valve member.

Referring now to FIG. 2, the inlet end 22 at the bottom of lower body portion 28 has a generally cylindrical, depending rim or flange 52 which extends into a cylindrical opening 54 in cap 20. The opening 54 extends to and communicates with a larger-in-diameter threaded cylindrical wall surface 56 where a shoulder 58 is formed between opening 54 and the cylindrical cavity defined by wall surface 56. Wall surface 56 is threadably received on the threaded neck 24 of container 26.

The inside wall of the depending rim 52 has an annular groove 60 in which is snap-fittingly received an annular detent 62 on an insert member 64.

The insert member 64 is specially configured, as will be described further below, and is press-fitted into the cylindrical hollow within the depending rim 52 and has an upstanding cylindrical boss 66 which is received in a generally, vertically disposed, cylindrical cavity 68 extending upwardly from the bottom or inlet end 22 of lower body portion 28 into lower body portion 28.

The insert member 64 is generally cylindrical with an outer, radially extending, mounting flange 70 which seats adjacent shoulder 58 and can be held thereagainst by an elastomeric gasket 72 press-fitted into the cap 20 against flange 70 as shown.

The cylindrical boss 66 is eccentric to the central axis of the insert member 64 and extends upwardly from an upper surface 74 thereof which abuts the bottom or inlet end 22 of lower body portion 28.

Extending downwardly from flange 70 is a cylindrical formation 76 having a cavity 78 therein and a mound portion 80 which is in line with cylindrical boss 66 and eccentric of the center of cylindrical formation 76. A first bore 82 is formed in the mound portion 80 and extends upwardly into the insert member 64. A second bore 84 extends downwardly into the cylindrical boss 66 opposite first bore 82 and in general alignment, preferably coaxial therewith. A third smaller-in-diameter bore 86 extends between and communicates with the first and second bore 82 and 84 within the insert member 64.

Press-fitted within the first bore 82 is a dip tube 88 which extends downwardly into the container 26.

As will be described in detail hereinafter, the second bore 84 comprises part of a one-way check valve assembly 90.

For venting the container 26, a vent passage 92 extends between cavity 78 and upper surface 74 of insert member 64. A relief area 93 is formed in the upper surface 74 and communicates through a vent port 94 in lower body portion 28 and a vent port 95 in sleeve 43 to a forward portion of cavity 44 within the sleeve 43. This communication is normally covered by piston 34 but is open to the ambient environment for allowing air into the container 26 as liquid is dispersed therefrom when the piston 34 is moved into the cavity 44. A similar vent structure is disclosed in the Steyns et al U.S. Pat. No.

4,072,252 which is assigned to the assignee of this patent application, The AFA Corporation of Hialeah, Fla.

The cylindrical boss 66 extends into the cavity 68, to a shoulder 91 of the cavity 68. A smaller-in-diameter cavity extension 96 of the cylindrical cavity 68 extends upwardly into upper body portion 30. Here, in the upper body portion 30, a horizontal extending passageway 97 communicates the cavity extension 96 with the nozzle assembly 14.

Figure 4:
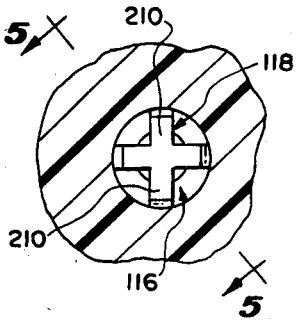
FIG. 4 is a fragmentary sectional view and is taken along line 4—4 of FIG. 3.

The check valve assembly 90 includes a lower ball 98 seated on a conical valve seat 99 at the lower end of second bore 84 in the cylindrical boss 66. A specially configured elongate valve member 100 which has an inverted umbrella shape and which has an upper rod portion 102 extending into cavity extension 96 and against a top 103 of the cavity extension 96 and a lower rod portion 104 which extends into the second bore 84 and has a bottom 105 which forms a stop for limiting upwardly movement of the lower ball 98. The upper end of the second bore 84 is countersunk, i.e. has a larger-in-diameter cavity portion 106 forming a shoulder 108 into which cavity portion 106 is received an annular formation 110 of the valve member 100 located in between the rod portions 102 and 104. This annular formation 110 has at the upper end thereof a frusto-conical skirt or umbrella 112 which extends upwardly and radially outwardly from the annular formation 110 so as to engage a cylindrical wall surface 113 of the cavity portion 106. A lower edge 114 of the annular formation 110 seats on the shoulder 108 and has spaces 116 (FIG. 4) between ribs 118 (FIGS. 4–7) of the formation 110 permitting communication between the second bore 84 and the cavity portion 106.

The valve assembly together with trigger handle 16, piston 34, cavity 44 and spring 50, form a pump 120 which also includes a port 122 in a side wall of cylindrical boss 66 which communicates the second bore 84 with an opening 124 in body 12 between cavity 44 and cavity 68.

In operation of the pump 120, when trigger handle 16 is squeezed, piston 34 is pushed into cavity 44 to push fluid in cavity 44 through opening 124 and port 122 and against skirt 112, moving skirt 112 inwardly so that the expressed fluid flows from cavity portion 106 through cavity extension 96 and horizontal passageway 97 to nozzle assembly 14 at the same time container 26 is vented.

Then, when trigger handle 16 is released, spring 50 pushes piston 34 out of cavity 44 creating a vacuum in second bore 84 which draws liquid up through dip tube 88, third bore 86, past ball 98 and through second bore 84, port 122, opening 124 and into cavity 44 ready to be dispensed, i.e., sprayed, on the next squeezing of trigger handle 16.

To minimize, if not altogether prevent, malfunction of pump 120, a guide post 130 extends horizontally from the rear end of cavity 44 for receiving and guiding spring 50 at one end thereof. Then, piston 34 has an annular cavity 132 extending into the inner end portion 42 thereof to form a guide pin 134 therein around which the other end of spring 50 is received. The length of post 130 or pin 134 can be varied to provide a metering function, i.e., to increase or decrease the effective stroke of piston 34 and the amount of fluid dispensed on each "trigger squeeze".

The inner end portion 42 of piston 34 has a special configuration which is generally annular in shape and of larger diameter than the body of piston 34. The annular inner end portion 42 has a concave, arcuate in cross-section, annular groove extending between a forward flared annular ridge and a rearward flared annular ridge. Each of the ridges has a diameter slightly greater than the diameter of the cavity 44 to provide a frictional/sealing fit of the annular inner end formation 42 of piston 34 in cavity 44. To facilitate flexing of the annular ridges, the inner end portion 42 has a frustoconical opening extending outwardly from the annular cavity 132 toward the rearward annular ridge. Then an axially facing annular groove is provided at the forward end of the annular inner end formation 42 radially inwardly of the forward annular ridge. Also, to facilitate insertion of the inner end formation or portion 42, cavity 44 has a chamfer 135 where it opens on the front side 46 of lower body portion 28.

Engagement of pin 134 with post 130 or engagement of the rear edge of inner end portion 42 with the rear end of cavity 44 limits the inward stroke of piston 34 on the squeezing of trigger handle 16.

On the other hand, engagement of an upper shoulder 136 of trigger handle 16 with an underside 138 of a nose bushing 140 which forms part of nozzle assembly 14 and which is situated beneath the upper body portion 30, limits the outer stroke of piston 34.

Turning now to nozzle assembly 14, it will be appreciated that the nozzle assembly 14 has an off position, a stream and a spray mist position and includes the nose bushing 140 which has a cylindrical section 141 that is received partly in a part annular, horizontally extending, slot 142 in the outlet end 15 of the upper body portion 30 and about a cylindrical body section 143 which is coaxial with passageway 97. The nose bushin 140 further includes a forward formation 144 including an annular cavity 145 within an annular nozzle mounting portion 146 and about a center portion 147 which is eccentric to cylindrical section 141. The annular cavity 145 communicates with the passageway 96 and the center portion has an axial cavity 148. Ports 149 in the wall of center portion 147 communicates annular cavity 145 with axial cavity 148.

Then, nozzle assembly 14 further includes a stream nozzle 150 that has an off position, a stream position and a spray mist position which has an outer cap formation 152 which is snap-fittingly received over the annular nozzle mounting formation 146 and an inner cap formation 154 which is received over the outer end of center formation 147. A stream forming orifice 156 coaxial with and extending through cap formations 152 and 154 communicates with axial cavity 148. This nozzle assembly is similar to the nozzle assembly disclosed in the Quinn et al U.S. Pat. No. 4,234,128.

Figure 3:
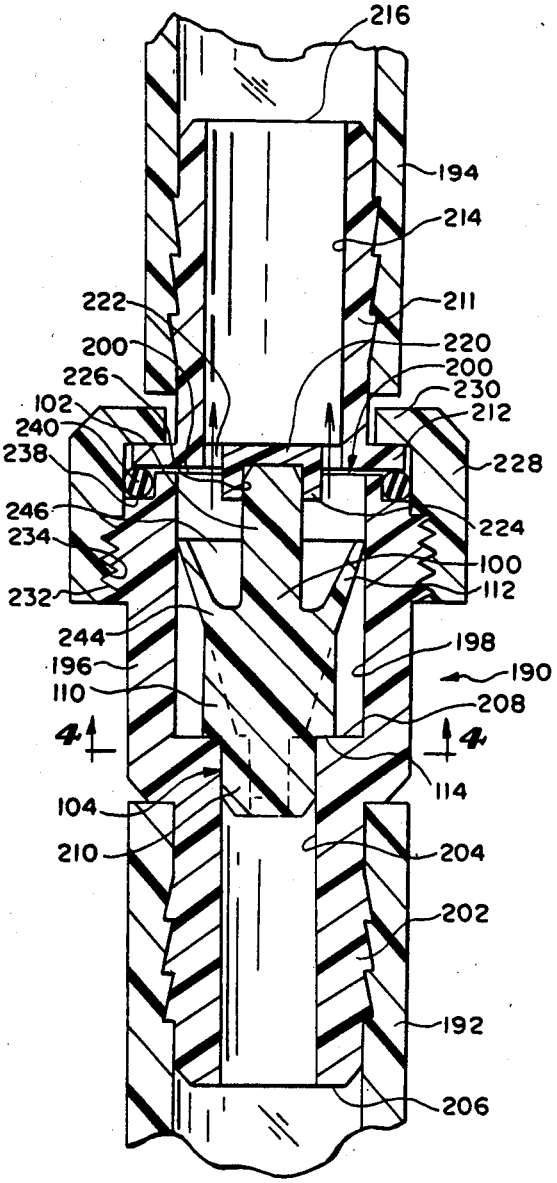
FIG. 3 is a longitudinal sectional view of the conical skirt/umbrella valve member mounted in a fluid line.
Figure 6:
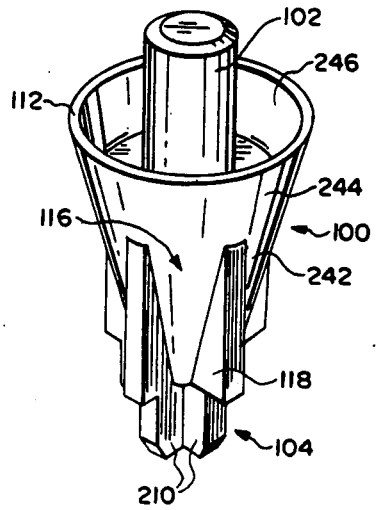
FIG. 6 is a perspective view of the conical skirt/umbrella valve member viewing same from a position above the valve member.
Figure 7:
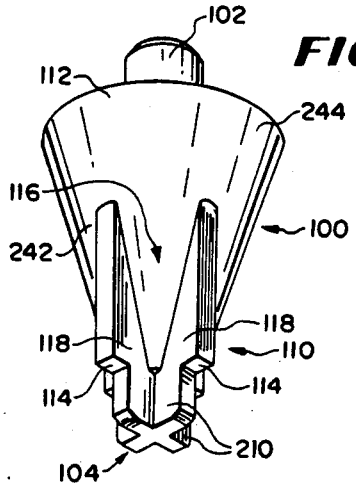
FIG. 7 is a perspective view of the conical skirt umbrella valve member viewing same from a position below the valve member.

Although the valve member 100 is designed for specific use in a trigger sprayer it could be used in other environments and FIG. 3 shows a check valve assembly 190 which is mounted in line between two conduits or tubings 192 and 194 and which includes the valve member 100 having upper rod portion 102; lower rod portion 104 (forming part of the annular formation 110); frusto-conical skirt 112 and annular formation 110 comprising ribs 118 having spaces 116 therebetween. The valve member 100 shown in FIG. 3 and used in valve assembly 190 is indentical to the valve member 100 shown in FIG. 2 except for the fact that the rod portion 102 is shorter.

The assembly 190 further includes a generally cylindrical housing 196 having a cylindrical cavity 198 therein opening onto a downstream end 200 of the housing 196. The housing 196 also has formed thereon a smaller-in-diameter, ribbed, connector/fitting 202 which has a smaller-in-diameter (than the diameter of cavity 198) throughbore 204 therein that opens onto an upstream end 206 of the housing 196. The throughbore 204 opens into the bottom of the cavity 198 forming thereby an annular shoulder 208 at the bottom of the cavity 198. As shown, a lower, and less wide, portions 210 of the ribs 118 are received in the bore 204 and define the lower rod portion 104. The lower seating edges 114 of the formation rest on the annular shoulder 208.

The valve assembly 190 not only includes the valve member 100 within the housing 196 but also an upper, ribbed, connector/fitting 211 which is received within the upper tubing or conduit 194. The connector/fitting 211 has a lower flange 212 and is adapted to be positioned over upper downstream end 200 of the housing 196. The connector/fitting 211 has a bore 214 therein which opens onto a downstream end 216 of the connector/fitting 211 and extends through the connector/fitting 211 to a bottom wall 220 which is generally coplanar with the flange 212. The bottom wall 220 has at least four openings 222 therethrough (two of which are shown in FIG. 3) and has a depending annular ring formation 224 which defines a cavity 226 into which the upper rod portion 102 is received.

The wall 220 prevents upward movement of the valve member 100 and serves to hold the valve member 100 within the cavity 198 when the connector/fitting 211 is fixed in position on the upper downstream end 200 of the housing 196. This is accomplished by means of a threaded collar 228 which has an upper inwardly extending annular flange 230 which is received over the flange 212 of the connector/fitting 211. The collar 228 has a thread formation 232 on the inner surface thereof which is adapted to mate with and threadingly engage a mating thread formation 234 on the upper outer surface of the housing 196.

For sealing purposes, the upper end 200 of the housing 196 has an outer annular shoulder 238 in which is received a resilient O-ring 240. The flange 212 engages the O-ring 240 and compresses same against the annular shoulder 238 to establish a fluid tight seal when the collar 228 is screwed or threaded onto the housing 196 to secure the upper, ribber, connector/fitting 211 adjacent the upper end 200 of the housing 196 as shown.

Figure 5:
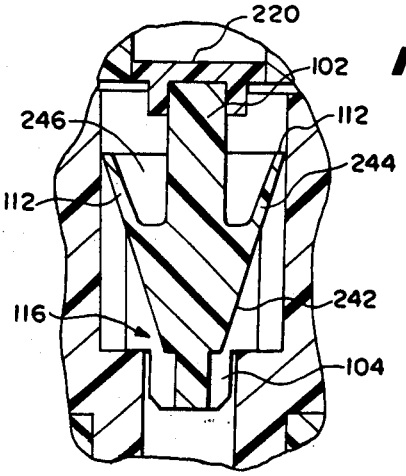
FIG. 5 is a fragmentary sectional view of the conical skirt/umbrella valve member and is taken along line 5—5 of FIG. 4.

Referring now to FIGS. 4–7, the annular formation 110 includes the four ribs 118 which extend downwardly from a conical outer surface 242 of the valve member 100, the upper portion of which is defined by the frusto-conical skirt portion 112. In this respect and as shown in FIGS. 3 and 5, the lower portion of the valve member 100 includes a solid frusto-conical body 244 with an annular frusto-conical caivty 246 being defined within the skirt 112 and the upper rod portion 102 above the body 246.

The lower less wide portions 210 of the ribs 118 are integral with the ribs 118 and, as noted above, define the lower rod portion 104.

Figure 8:
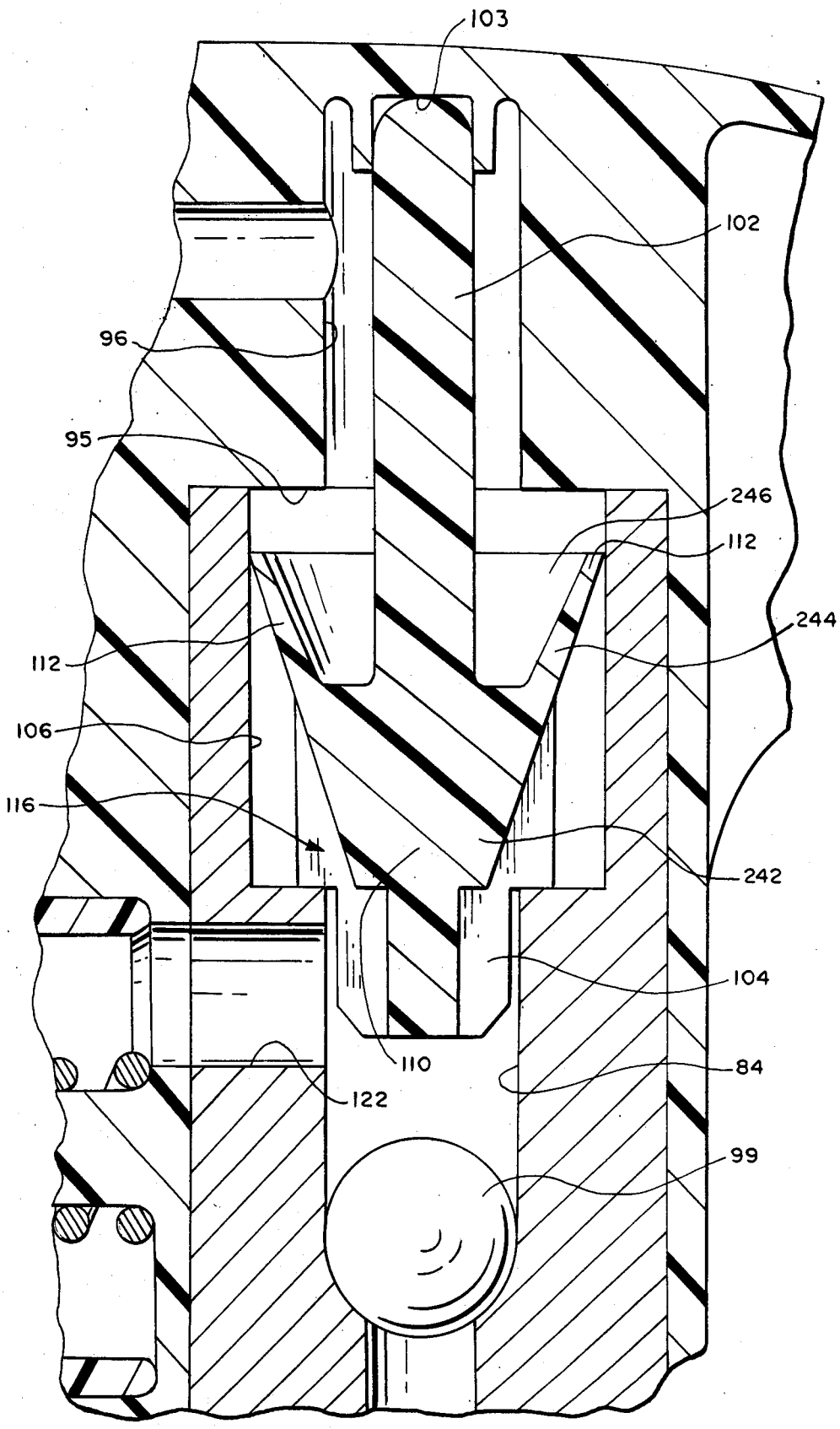
FIG. 8 is a fragmentary sectional view of a valve member similar to the valve member shown in FIG. 5, mounted in the insert member and in the body of the trigger sprayer shown in FIG. 2.

In FIG. 8 is shown a valve member 100 which has a short rod portion 104 received in the bore 84 inthe insert member 64 of the trigger sprayer 10 shown in FIG. 2 and a long rod portion 102 received inthe cavity extension 96 in the body 30 of the trigger sprayer 10 shown in FIG. 2.

From the foregoing description, it will be apparent, that the trigger sprayer 10 of the present inventio nhas a number of advantages, some of which have been described above, and other of which are inherent in the invention.

First of all it is noted, that a standardized body 12 is provided which is adapted to receive at the outlet end 15, a standardized nozzle bushing 140 and a standardized removable adjustable spray and fine mist nozzle 150 which has an OFF position and which provides a closure function during shipping and between uses of the trigger sprayer 10. Also, insert member 64 can be replaced with a modified insert member for accommodating a modified valve assembly.

Further, the special construction of piston inner end portion 42 provides a frictional, fluid tight, sliding engagement of piston 34 in sleeve cavity 43 in cavity 44 with the portion 42 cooperating with a container vent system, such as defined by cavity 78, passageway 92, relief 93 and passageways 94 and 95 in body portion 28 and sleeve 43 to cavity 44.

Further, with the trigger sprayer 10 of the present invention, a number of different trigger sprayer assemblies can be assembled since the trigger sprayer 10 can utilize a high pressure piston 34 which is received within the bore in the sleeve 43 or a standard piston in cavity 44.

It will also be understood that four nozzle assemblies can be provided; one being a standard spray nozzle with an OFF position, SPRAY position and STREAM position, or a standard spray nozzle with an OFF position and a SPRAY or STREAM position.

Alternatively, a fine spray mist nozzle assembly can be provided with the OFF, SPRAY and STREAM positions in one nozzle assembly or with OFF and SPRAY or STREAM positions in the other nozzle assembly.

With the various combinations that are possible, a large number of different models of trigger sprayers can be created with the various sub-assemblies of the trigger sprayer 10 described above.

Then a check valve assembly 90 is provided including the umbrella check valve 100 and a ball check valve 98.

The umbrella shaped valve member 100 has a number of advantages. For example, it provides a positive, one-way shutoff valve which, because of the internal resistance of the seal provided between the skirt 112 and bore 84, lends itself to controlling flow of viscous materials as well as other liquids.

Additionally, the umbrella valve member 100 works as a hydraulic valve which is only activated by pressure exerted on same by fluid or viscous material.

Further, the conical shape of the skirt 112 allows the fluid to collapse the seal between the skirt 112 and the wall of the bore 87 inwardly of the axis of the valve member 100 such that there is no back pressure or loss of functionality of the valve member 100. Furthermore, the valve member 100 operates solely as a valve mechanism with metering of the output fluid being achieved by another mechanism.

Other advantages of the umbrella valve member 100 are as follows:

1. In the ttigger sprayer 10 the pump 120 and vavle assembly 90 can be primed with a minimum amount of strokes and once primed it will not lose the fluid; on squeezing of the trigger, the valve assembly 90 is immediately reprimed.

2. External forces such as squeezing the bottle or container 26 will not activate the valve assembly 90.

3. There is no post-activation that will allow fluid to be expelled through the orifice 156 in the nozzle 14 when the trigger 16 is released and the valve assembly 90 will not allow post throttling of fluid through the bore 84.

4. The simplicity of design of the valve member 100 facilitates plastic mold design and plastic cavitation design of the valve member 100.

5. The flexibility of the outer sealing surface 242 of the frusto-conical skirt 112 allows for some imperfection in the outer sealing surface 242 since the flexibility of the skirt 112 will force the surface 242 against the wall of the bore 84 or cavity 198.

Preferably, the valve member 100 is made of lowdensity polyethylene or equivalent material, the material composition being based upon the compatibility of the particular material with fluids to be dispensed.

Although the trigger sprayer 10 shown in FIG. 2 shows a lower valve including a ball 98 and an upper valve comprising the valve member 100, both the upper and lower valves can be defined by umbrella valve member 100.

I claim:

1. A hand manipulatable trigger sprayer comprising:

a body having an outer surface, passage means therein including a linear passageway portion, said passage means extending between an inlet adapted to be coupled to a source of liquid to be dispensed and an outlet adapted to be connected to a nozzle through which the liquid is dispensed, said linear passageway portion having a cylindrical wall, said body further having a pump chamber therein defined by an inner end wall and an open outer end opening onto said outer surface of said body and an opening extending into said inner wall and said body, said opening communicating between said pump chamber and said passage means, first upstream check valve means in said passage means between said inlet and said opening for permitting forward flow of liquid from the source into said passage means but not reverse flow to the source, second, downstream check valve means in said linear passageway portion downstream from said opening for permitting forward flow of liquid to said outlet, but not reverse flow to said pump chamber, said second downstream check valve means comprising a rod and a flexible, frusto-conical shaped skirt member which is fixed to and flares outwardly from said rod in a downstream direction to an outer circular end edge, which is prevented from moving axially downstream in said linear passageway portion, and which has an outer marginal area adjacent said end edge that normally is in engagement with said cylindrical wall of said linear passageway portion, said rod having an upstream portion which extends axially upstream from said skirt member and said skirt member being deformable radially inwardly under liquid pressure to allow liquid to flow downstream past said skirt member, pumping means comprising a piston which is situated in said pump chamber and which has an outer end and an inner end and means for biasing said inner end of said piston away from said inner end wall of said pump chamber, and actuating means comprising a trigger and means for mounting said trigger to said body in a manner allowing movement of said trigger relative to said body, said trigger being positioned to engage said outer end of said piston for moving said piston, once said trigger is squeezed, into said pump chamber against said biasing means to force liquid from said pump chamber through said opening, into said passage means and past said skirt member, and, when said trigger is released, said biasing means forces said piston away from said inner end wall creating a suction which draws liquid from the source through said first upstream check valve means into said passage means through said opening and into said pump chamber.

2. The sprayer in claim 1 wherein said lower check valve means is defined by a ball and a valve seat in said passage means on which said ball is seated.

3. The sprayer of claim 2 wherein said downstream valve means is made of a flexible elastomeric material such as polethylene.

4. The sprayer of claim 1 wherein said body has an upper generally horizontally extending portion and a lower generally vertically extending portion, said passage means extending from said outlet which is located at one end of said upper portion to said inlet which is located at the bototm of said lower portion for providing a liquid flor path through said body, said body further having a cylindrical hollow in the lower end of said lower body portion and a cylindrical cavity extending from the inner surface of said hollow into said lower body portion and forming part of said passage means, said sprayer further comprises an insert member which is received in said hollow and cavity and which has an at lest partially cylindrical passageway extending therethrough forming part of and communicating with said body passage means, means for coupling the lower end of said insert member to a container of liquid, said upstream check valve means, which permits liquid flow upwardly therethrough from the container to which said insert member is coupled, being located in said at least partially cylindrical passageway, and said insert member having an opening therein communicating between said opening in said body and said at least partially cylindrical passageway.

5. The sprayer of claim 4 wherein said passageway through said insert member comprises a first lower bore, a second upper bore and a third smaller-in-diameter bore therebetween, said sprayer includes a dip tube having one end press fitted into said lower bore and another end depending downwardly into the container, and the lower end of said second bore is rounded to form a valve seat for said upstream check valve means.

6. The sprayer of claim 4 wherein said insert member has a cylindrical boss which is press-fitted within said cylindrical cavity, and said cylindrical boss is eccentric to the central axis of said cylindrical hollow.

7. The sprayer of claim 4 including a cap and wherein said insert member includes a radially extending flange at the lower end thereof which is received within said cap for coupling said cap to said body, and said sprayer further includes an annular elastomeric washer which is press fitted into said cap against said flange for forming a fluid tight seal between said insert member and the interior of said cap which is adapted to be connected to an outlet opening of the container.

8. The sprayer of claim 4 wherein said insert member has a first vent passageway therein extending from the lower end thereof to and beneath the bottom of said lower body portion and in communication with a second vent passageway through said lower body portion and opening into said pump chamber in the area of said piston, said second vent passageway being open to the ambient environment on the completion of an inner stroke of said piston for venting the interior of the container and normally being closed by said piston when said piston is in a non-pumping position.

9. The sprayer of claim 4 wherein said passage means within said body includes the cylindrical cavity in which said insert member is received and said body has a cavity extension extending upwardly from said cylindrical cavity and a horizontal passageway extending between said cavity extension and said outlet, said cavity extension and said horizontal passageway forming parts of said passage means.

10. The sprayer of claim 1 wherein said downstream check valve means is defined by an elongate valve member having said upstream rod portion and a downstream rod portion, said downstream rod portion extending into said passage means and having an end which forms a stop and which bears against an internal wall in said body, said linear passageway portion having a larger-in-diameter portion through which said valve member extends, said skirt member being fixed to said downstream rod portion of said valve member, and said valve member has an annular formation received in said larger-in-diameter portion of said linear passageway portion, said annular formation having an outer diameter less than the diameter of said larger-in-diameter linear passageway portion, said frusto-conical skirt member extending axially downstream of and radially outwardly from said annular formation in said larger-in-diameter portion of said linear passageway portion, and frictionally and sealingly engages said cylindrical wall thereof, and said frusto-conical skirt member being deflectable under liquid pressure for allowing liquid to pass axially thereof through said larger-in-diameter portion to said outlet.

11. The sprayer of claim 1 wherein said passage means has a stepped chamber therein, a larger diameter downstream portion of said chamber forming said linear passageway portion and an annular shoulder being defined at the junction between the larger diameter downstream portion and a smaller-in-cross-section upstream portion of said passage means and wherein said rod of said second downstream valve means includes a formation which is received in said larger diameter downstream portion portion for seating on said annular shoulder and said upstream rod portion extends into said smaller-in-cross-section upstream portion of said passage means.

12. The sprayer of claim 11 wherein said formation is defined by at least two ribs extending radially outwardly and axially of said rod and integral therewith.

13. The sprayer of claim 12 wherein said ribs are situated diametrically opposite each other.

14. The sprayer of claim 13 wherein said formation comprises two additional ribs which are situated diametrically opposite each other in a plane normal to the plane of said two first ribs.

15. The sprayer of claim 12 wherein each of said ribs has a stepped outer edge with an outer portion extending generally int he same direction as the elongate axis of said rod, and inner portion which is received in said smaller-in-cross-section chamber portion, and a rib shoulder which is situated between said outer and inner portions and which rests on said annular shoulder.

16. The sprayer of claim 15 wherein said rod, in the area between said ribs, has a conical surface which ends at the plane of said rib shoulders, the cross section of said conical downstream valve means body at the location of said rib shoulders being less than the diameter of said smaller-in-cross-section upstream portion of said passage means such that flow through passages are defined between said ribs and betwen said upstream portion of said passage means.

17. The sprayer of claim 1 wherien said pump chamber includes a generally cylindrical cavity in said body, and said biasing means comprises a spring positioned in said generally cylindrical cavity between said inner end wall thereof and said inner end of said piston for biasing said piston outwardly of said generally cylindrical cavity.

18. The spryaer of claim 17 wherein said inner end of said generally cylindrical cavity has a guide post extending axially of the cavity for receiving one end of said spring thereon, and said piston has a guide pin on the inner end thereof for receiving and guiding the other end of said spring, the distance between the outer ends of said pin and said post defining the stroke of said piston such that length of said pin and said post provide a metering function and control the amount of fluid dispensed on each squeezing of the trigger.

19. The sprayer of claim 17 wherein said inner end of said piston has an inner, formation specially configured for frictionally and sealingly engaging the inner surface of said generally cylindrical cavity.

20. The sprayer of claim 19 wherein said special formation at the end fo said piston comprises a first, forward, annular ridge located on the outer surface of said piston and having a diameter greater than the inner diameter of said generally cylindrical cavity, a second, rearward, annular ridge having a diameter greater than the diameter of said generally cylindrical cavity, and an arcuate in-cross-section annular groove extending around said annular formation and between said ridges.

21. The sprayer of claim 17 wherein said trigger is pivotally connected to said body, is engageable with the outer end of said piston, and is hand manipulatible for pushing said piston into said generally cylindrical cavity against the action of said spring, thereby to force liquid ins aid generally cylindrical cavity on an inner stroke of said piston from said generally cylindrical cavity through said opening, into said passage means and past said downstream check valve means to said outlet of said passage means, and on an outer stroke of said piston to draw fluid into said generally cylindrical cavity from a liquid source through said upstream check valve means.

22. The sprayer of claim 1 including means for connecting said sprayer to a container of liquid and said sprayer having vent passageway means extending through said body between said pump chamber and said means for connecting said sprayer -to a container of liquid, said vent passageway normally being closed by said piston and being open, to vent the container, when said piston is moved into said pump chamber.

23. The sprayer of claim 17 including a sleeve insert received in said cylindrical cavity, and said piston having an outer diameter approximately the same as the inner diameter of said sleeve insert.

24. The sprayer of claim 1 wherein said piston outer end is rounded and said trigger includes a trigger handle pivotally mounted to said body and having a rounded seat and guide formation on a back side thereof for sliding engagement with said rounded outer end of said piston.

25. The sprayer of claim 1 including a nozzle assembly mounted to said body and coupled to said outlet of said passage means.

26. The sprayer of claim 25 wherein said nozzle assembly includes a specially configured nose bushing mounted to one end of said body and an adjustable, replaceable nozzle snap-fittingly mounted on a forward end of said nose bushing.

27. The sprayer of claim 26 wherein said nozzle comprises an outer cap formation received over and snap-fittingly mounted on said forward end of said nose bushing and an inner cap formation received over a center portion of said forward end of said nose bushing, said center portion having an axial cavity therein and said nozzle having a metering orifice extending through said cap formation and communicating with said axial cavity.

28. The sprayer of claim 27 wherein said nozzle is rotatable on said center portion between two positions of said nozzle.

29. The sprayer of claim 27 wherein said nozzle is rotatable on said center portion between three positions of said nozzle.

30. The sprayer of claim 29 wherein said nozzle has an off position, a spray mist position and a stream discharge position.

31. The sprayer of claim 1 wherein said rod extends axially downstream from said skirt member to an end thereof, and said body has, in said passage means stop means therein and said end of said rod bears against said stop means.

32. The sprayer of claim 1 wherein said rod extends from said skirt member fixed thereon axially upstream and downstream.

33. The sprayer of claim 1 wherein said rod has a downstream rod portion with a downstream end having stop means for engaging a formation in said body to prevent axial movement of said second check valve means downstream in said linear passageway portion.

34. The sprayer of claim 1 wherein said second valve means includes a rod portion extending downstream from said skirt member which is fixed to and which extends outwardly from said rod portion, said rod portion having a downstream end which forms said stop means which engages a wall of said passage means in said body.

35. The sprayer of claim 4 wherein said cylindrical hollow has an annular groove therein and said insert member has an annular detent on an outer surface thereof which is snap-fittingly received in said annular groove in said cylindrical hollow.

36. A hand manipulatable trigger sprayer comprising:

a body having passage means therein including a rectilinear passageway portion, said passage means extending between an inlet adapted to be coupled to a source of liquid to be dispensed and an outlet adapted to be connected to a nozzle through which the liquid is dispensed, said rectilinear passageway portion having a cylindrical wall;

pumping means;

a trigger associated with said pumping means;

upstream check valve means and downstream check valve means in said passage means defining therebetween a space in said passage means associated with said pumping means and adapted to take up liquid to be dispensed by operating said pumping means upon actuation of said trigger, said upstream check valve means preventing reverse flow of liquid to the source upon pressurization in said space and said downstream check valve means preventing reverse flow into said space upon creation of a suction in said space upon release of said trigger, said downstream check valve means being situated in said rectilinear passageway portion, said downstream check valve means comprising a rod and a flexible, frusto-conical shaped shirt member which is fixed to and flares outwardly from said rod in a downstream direction to an outer circular end edge and which has an outer marginal area adjacent said end edge that normally is in engagement with said cylindrical wall of said rectilinear passageway portion, said skirt member being deformable radially inwardly under liquid pressure to allow liquid to flow downstream past said skirt member, and said rod having a portion which extends axially downstream from said skirt member into engagement with a stop means for the downstream end of said rod to bear against said stop means against the dragging force of liquid flowing at the circumference of said skirt member and rod upon actuation of said trigger and a portion which extends axially upstream.

37. The sprayer of claim 36, characterized in that said stop means comprises axially extending wall elements providing radial stop surfaces at the circumference of the downstream end of said rod.

38. The sprayer of claim 36 characterized in that said upstream rod portion is in engagement with upstream abutment means preventing excessive movement of said rod in counter-direction to said direction of flow of liquid to be dispensed.

39. The sprayer of claim 38, characterized in that said upstream abutment means are formed by an annular shoulder in said rectilinear passageway portion engaged by a shoulder on said upstream rod portion.

40. The sprayer of claim 34, characterized in that said rectilinear passageway portion is formed in an insert member in said body.

* * * * *

UNITED STATES PATENT AND TRADEMARK OFFICE

CERTIFICATE OF CORRECTION

PATENT NO. : 4,669,664

DATED : June 2, 1987

INVENTOR(S) : RICHARD P. GARNEAU

It is certified that error appears in the above-identified patent and that said Letters Patent is hereby corrected as shown below:

Colume 2, Line 53 "flates" should be --flares--.
Colume 10, Line 47 "lower" should be --first--.
Colume 7, Line 55 "caivty" should be --cavity--.
Colume 8, Line 62 "vavle" should be --valve--.
Colume 10, Line 33 "lest" should be --least--.
Colume 10, Line 25 "flor" should be --flow--.
Colume 12, Line 15 "spryaer" should be --sprayer--.

Colume 10, Line 24 "bototm" should be --bottom--.
Colume 11, Line 62 "int he" should be --in the--.

Signed and Sealed this

Twenty-second Day of August, 1989

*Attest:*

DONALD J. QUIGG

*Attesting Officer*

*Commissioner of Patents and Trademarks*